US006531672B2

(12) United States Patent
Malloy

(10) Patent No.: US 6,531,672 B2
(45) Date of Patent: Mar. 11, 2003

(54) APPARATUS FOR SORTING AND COUNTING SPHERICAL OBJECTS

(75) Inventor: Terence P. Malloy, South Berwick, ME (US)

(73) Assignee: Car Component Technologies, Inc., Bedford, NH (US)

( * ) Notice: Subject to any disclaimer, the term of this patent is extended or adjusted under 35 U.S.C. 154(b) by 23 days.

(21) Appl. No.: 09/781,754

(22) Filed: Feb. 12, 2001

(65) Prior Publication Data

US 2002/0112997 A1 Aug. 22, 2002

(51) Int. Cl.[7] ..... B07C 5/10
(52) U.S. Cl. ..... 209/579; 209/586; 356/639
(58) Field of Search ..... 209/579, 586, 209/576, 577, 656; 356/638, 639, 640

(56) References Cited

U.S. PATENT DOCUMENTS

| | | | | |
|---|---|---|---|---|
| 3,737,033 A | | 6/1973 | Toth | |
| 4,172,527 A | | 10/1979 | Bost | |
| 4,457,622 A | * | 7/1984 | Kato et al. | 209/586 |
| 4,767,010 A | | 8/1988 | Bost | |
| 4,924,998 A | * | 5/1990 | Fuller, Jr. | 198/370.04 |
| 5,026,165 A | | 6/1991 | Faville | |
| 5,043,588 A | * | 8/1991 | DiGrande et al. | 356/640 |
| 5,139,150 A | * | 8/1992 | Fuller et al. | 209/576 |
| 5,160,978 A | * | 11/1992 | Faville | 209/579 |
| 5,167,328 A | | 12/1992 | Vinson | |
| 5,253,765 A | * | 10/1993 | Moorehead et al. | 209/586 |
| 5,414,634 A | * | 5/1995 | Morgan et al. | 209/702 |
| 5,812,269 A | | 9/1998 | Svetkoff et al. | |
| 5,825,017 A | | 10/1998 | Pryor | |
| 5,930,143 A | | 7/1999 | Savazzi | |

FOREIGN PATENT DOCUMENTS

| | | | | |
|---|---|---|---|---|
| FR | 2668962 A1 | * | 5/1992 | B07C/5/10 |
| JP | 59145941 A | * | 8/1984 | G01L/23/22 |
| JP | 03242272 A | * | 10/1991 | B07C/5/342 |
| WO | WO 91/03029 | * | 3/1991 | |

* cited by examiner

*Primary Examiner*—Donald P. Walsh
*Assistant Examiner*—Joseph Rodriguez
(74) *Attorney, Agent, or Firm*—McLane, Graf, Raulerson & Middleton, P.A.

(57) ABSTRACT

The present invention is directed to an apparatus and method for efficiently and accurately sorting spherical objects based on their diameters. The apparatus of the present invention comprises a support frame, an inclined measurement chute having a measurement channel through which a laser beam can be transmitted, a feeder for feeding spherical objects into the measurement chute, a laser micrometer, a plurality of receptacles for receiving the sorted objects, a sorter for directing the objects into one of the plurality of receptacles, and a computer for directing the sorter to place the objects into the appropriate receptacles. The method of the present invention comprises the steps of feeding the objects into an inclined measurement chute having a measurement slot through which a laser beam can be transmitted, measuring the diameter of the objects as the objects roll down the inclined measurement chute over the measurement slot by way of a laser micrometer, transmitting a signal from the laser micrometer to a computer, said signal identifying the diameter of the objects, and directing a sorter to place the objects into one of a plurality of receptacles based on the diameter of the objects.

16 Claims, 9 Drawing Sheets

APPARATUS FOR SORTING AND COUNTING SPHERICAL OBJECTS

FIELD OF THE INVENTION

The present invention relates to the field of devices used to sort and count spherical objects such as ball bearings.

BACKGROUND OF THE INVENTION

The ability to efficiently and accurately sort by size spherical objects such as ball bearings is critical for various applications in various industries. For instance, for those industries that recycle and restore automobile parts, it may be necessary to sort ball bearings of various dimensions. Ball bearings are used in axles and other automotive parts, and are manufactured with various diameters that may differ by ten thousands of an inch. In order to efficiently recycle and reuse the ball bearings, it may be necessary to quickly and accurately sort the ball bearings by diameter. Frequently, it is useful not only to sort the ball bearings, but also to count the number of ball bearings of particular dimensions.

Machines used to sort spherical objects typically employ two rotating cylinders that are mounted such that their axes gradually diverge from each other. This arrangement creates a gap that gradually widens as the axes of the cylinders gradually diverge from one another. The two cylinders typically are mounted so that their diverging ends are lower than their tapered ends, so that objects to be sorted will gradually gravity feed down toward the diverging ends. Objects to be sorted are fed to the rotating cylinders at the tapered ends, where there is a minimal gap between them. As the objects feed toward the diverging ends, the objects drop through the gap at the point where the width of the gap exceeds the respective diameters of the objects. Receptacles are situated below the cylinders to collect the objects dropping through the gap created by the diverging cylinders at various widths of the gap.

For example, U.S. Pat. No. 4,172,527, issued to Bost, discloses a bearing sorting device that employs a pair of rotating cylinders and a diverging gap between the cylinders. The cylinders are mounted on an incline, each having a drive assembly connected to one end for rotating the cylinders in opposite directions. The bearings to be sorted are fed into the cylinders at the higher end, and the bearings gradually feed down the sorting gap until the width of the sorting gap is sufficient to permit the bearings to drop through into receptacles positioned accordingly to collect the sorted bearings. After the sorting operation has been completed, the bearings having the smallest diameter would be deposited in the first receptacle and the bearings have the largest diameter would be deposited in the last receptacle.

U.S. Pat. No. 4,767,010, issued to Bost, improves upon the above apparatus by increasing the accuracy of the sorting. The patent discloses a similar apparatus that includes flexible couplings between the drive shafts and supporting shafts of the cylinders. The flexible couplings decrease the effect of radial stresses on the sorting cylinders, thereby decreasing unwanted distortions in the sorting gap.

Although these machines are able to sort spherical objects to a fairly high degree of precision, they are not able to efficiently separate objects based on preset measurement ranges. Nor do these machines selectively reject objects that do not fall within preset measurement ranges. Nor do these machines count the number of objects sorted by preset measurement ranges. Thus, there is a need for a sorting device that can accurately and efficiently sort objects into preset measurements ranges and simultaneously count the sorted objects. There is also a need for a sorting device that is able to reject objects that do not fit into preset measurement ranges.

SUMMARY OF THE INVENTION

The present invention is a device for accurately and efficiently sorting spherical objects such as ball bearings. In its elemental form the device utilizes a hopper or some alternative feeder used to temporarily store and feed the objects to be sorted. The objects are gravity fed individually into an inclined measurement chute where they gravity feed past a tiny slot that is cut perpendicular to the path of the objects as they roll down the sorting chute. As each object passes the slot, the diameter of the object is measured by a laser micrometer. The laser micrometer determines the diameter of the object and sends a signal indicating the measured diameter to a programmable logic controller or some other computing means.

The programmable logic controller directs a servomotor to rotate a sorting chute to the appropriate position and then drop the object into a particular outfall chute. The object will travel through the outfall chute into a receptacle for that object's particular diameter or range of diameter. The programmable logic controller maintains a running tally of the total number of objects sorted, as well as the number of each object measured at a particular diameter or range of diameter. If an object does not measure within one of the preset measurement ranges, the PLC directs the servomotor to place the ball in the outfall chute leading to a reject bin.

Because a laser micrometer is used to measure the diameter of each object, the precision of the ranges of diameters to be sorted can be extremely precise, essentially as precise as the laser micrometer utilized. Although the precision depends on the laser micrometer used, the best mode used by the inventor allows for objects to be sorted to forty millionths of an inch in diameter. This precision further allows for objects to be rejected if they have very small defects (such as foreign matter deposits) because the defects will cause distortion in the measured diameter. For instance, for particular applications utilizing ball bearings, very minor defects due to rust or carbon deposits may be significant, and the present invention allows for objects with these defects to be sorted out.

The present invention is efficient as well as accurate. The apparatus utilizes gravity to feed the spherical objects through a measurement chute and eventually into one of a plurality of receptacles situated below the measurement chute to receive the sorted objects.

It is an important aspect of this invention to provide a device for sorting spherical objects into preset measurement ranges at a high rate of speed.

It is a further aspect of the invention to provide a device whereby spherical objects can be sorted accurately into preset measurement ranges.

Another aspect of the invention is to provide a device for sorting objects to differences in diameter of eight millionths of an inch.

It is a further aspect of the invention to provide a device that will direct sorted objects to receptacles for collecting objects of a particular diameter or range of diameters.

It is another aspect of the invention to provide a device that will count the total number of objects sorted.

It is another aspect of the invention to provide a device that will count the number of objects sorted into each preset measurement range.

It is still another aspect of the invention to provide a device that will sort out objects that do not fall within a particular preset measurement range or ranges.

It is another aspect of the invention to provide a device that will sort spherical objects with a minimum amount of operator intervention or oversight.

It is another aspect of the invention to provide a device that will alert the operator when a preset number of objects of a given size has been sorted.

DETAILED DESCRIPTION OF THE INVENTION

Figure 1:
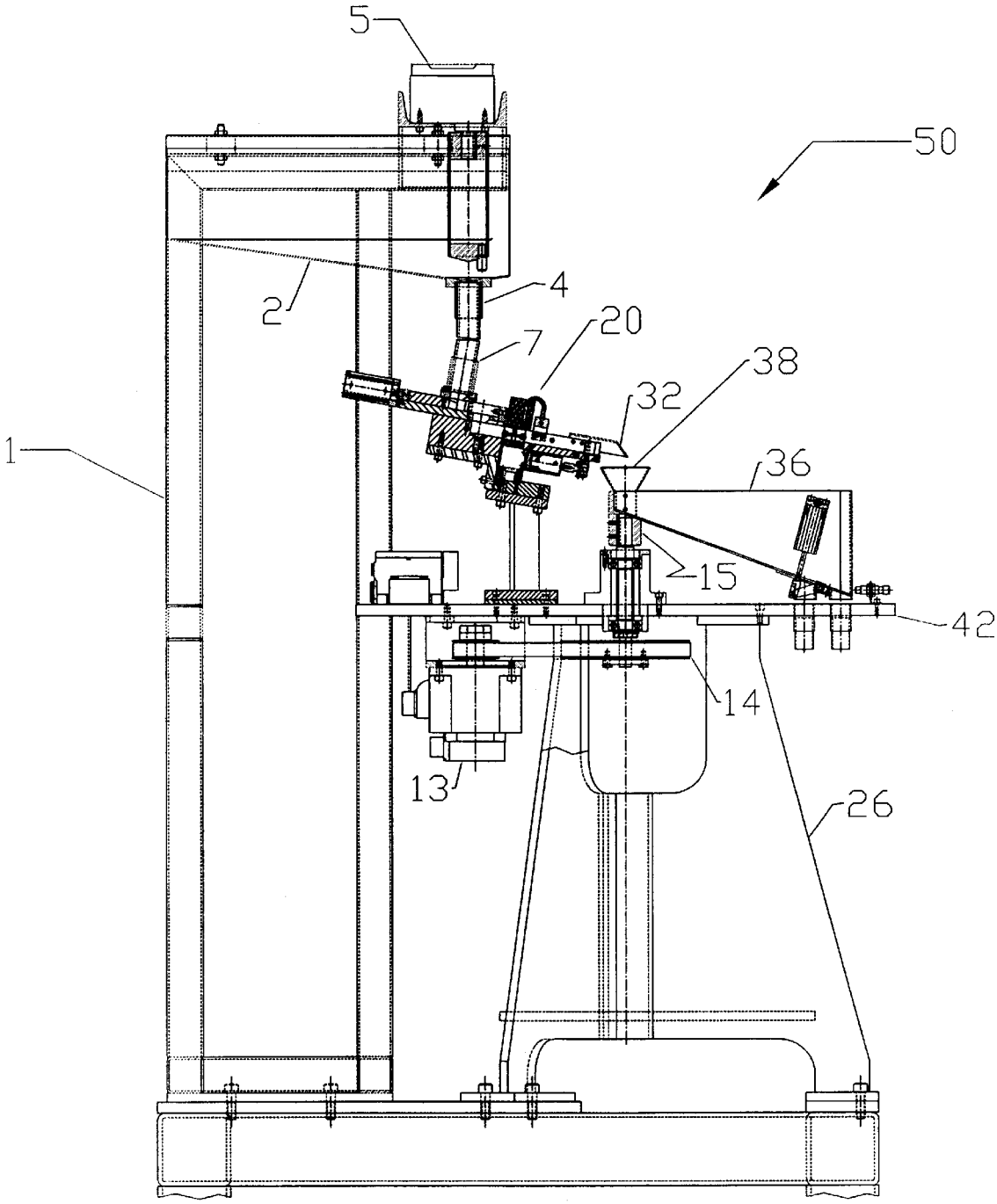
FIG. 1 is a side plan view of a sorting apparatus of the present invention.

Fundamentally, the sorting apparatus of the present invention includes a feeder for temporarily storing and feeding the objects to be sorted into an inclined measurement chute, the inclined measurement chute where the objects are measured, a laser micrometer for measuring the diameter of the objects, and a sorter for sorting the objects by directing individual objects into particular receptacles based on each object's respective diameter. FIG. 1 presents a side plan view of one embodiment of the sorting apparatus 50 of the present invention.

Figure 3:
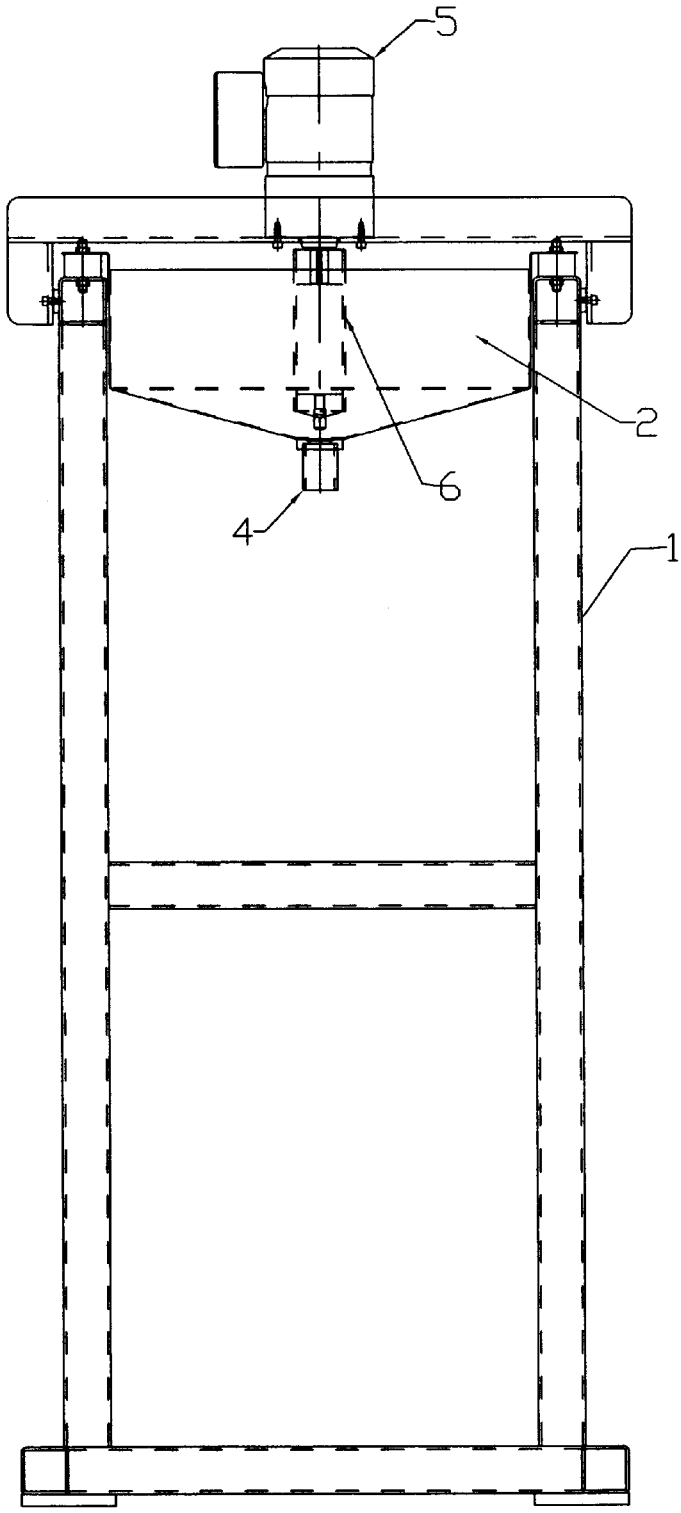
FIG. 3 is a side view of the feed hopper and agitator shaft assembly.

The invention includes a feeder mechanism for temporarily storing and feeding objects to be sorted into a measurement chute, in which the objects will be measured by a laser micrometer. In the preferred embodiment shown in FIG. 1, a feed hopper 2 is mounted to the upper portion of a support frame 1. As illustrated in FIGS. 1 and 3, the support frame of the present invention comprises two vertical members, with the lower end of each member coupled to a horizontal base platform. Connected to the upper ends of the vertical members are horizontal support arms. The support frame 1 of the present invention also includes a subframe assembly 26 fastened to the horizontal base of the support frame 1. Because various different structures can be used for the support frame and subframe of the present invention, and because these various structures would be readily apparent to those skilled in the art, a further detailed description of the support frame and subframe assembly is not provided herein.

Figure 2:
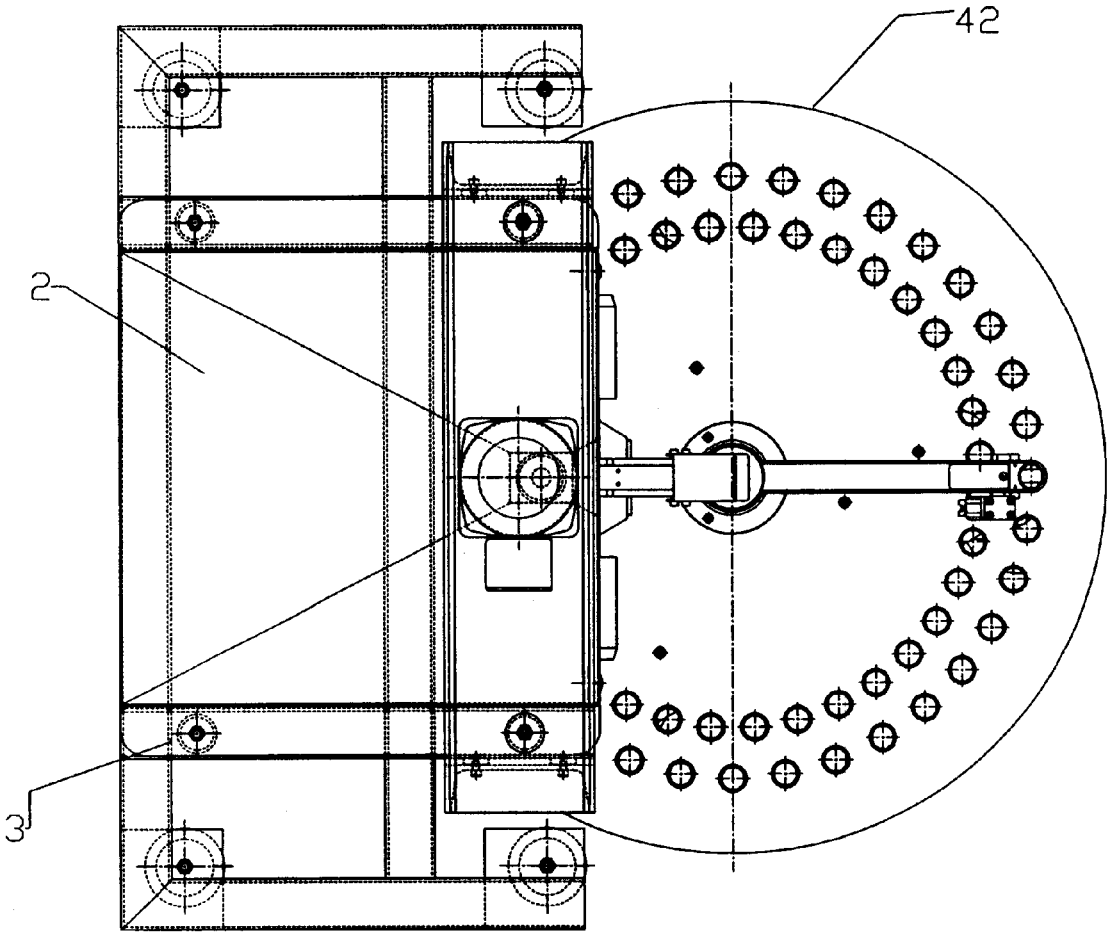
FIG. 2 is a top plan view of the sorting apparatus of the present invention.

As illustrated in FIGS. 2 and 3, the feed hopper 2 preferably is a container mounted on four anti-vibration pads 3 that are affixed to the support frame 1. The anti-vibration pads can be made of rubber, plastic, foam or some other material suitable for dampening any vibration transmitted between the feed hopper 2 and the support frame 1. The feed hopper 2 can be secured to the support frame 1 by nuts and bolts, screws or other suitable fasteners.

The feed hopper 2 essentially can be of any shape or size that will temporarily store the objects to be sorted before they are fed to the measuring and sorting mechanisms. The feed hopper 2 should be shaped such that the objects in it will gravity feed to an opening at the base of the feed hopper 2. The opening preferably is circular in shape and is sufficiently sized such that the largest of objects to be sorted will fit through the opening, but not so large that the openings will be likely to clog with multiple objects to be sorted. For example, if the largest object to be sorted has a diameter of one inch, an opening with a diameter of 0.9 inch would not be appropriate, but an opening with a diameter of 1.1 inches may be appropriate.

In the preferred embodiment of this invention, an agitator shaft 6 is positioned vertically and directly over the opening at the bottom of the feed hopper 2. The agitator extends into the hopper such that it is sufficiently close to the opening so that it can agitate the temporarily stored objects to ensure that they properly feed out of the feed hopper 2 through the opening. In the preferred embodiment, the agitator shaft 6 is mechanically coupled to a gear-motor 5 that provides the power to rotate the agitator shaft 6.

The feeder mechanism of the apparatus must include means for directing the objects from the feed hopper 2 to the measurement chute. In the preferred embodiment, fastened to the underside of the feed hopper 2 at the opening in the hopper is an outfall chute 4, which is a hollow tube through which objects will fall from the feed hopper 2. The outfall chute 4 is preferably a hollow cylindrical tube of sufficient inner diameter to allow the passage of the largest object to be sorted, and can be welded or fastened in some other conventional manner to the feed hopper 2. The outfall chute 4 is positioned directly over a measurement chute inlet tube 7 of sufficient inner diameter to allow the passage of the largest object to be sorted. Preferably, the measurement chute inlet tube 7 is positioned such that the upper end of the tube is not in contact with the lower end of the outfall chute 4. A small gap exists between the lower end of the outfall chute 4 and the upper end of the measurement chute inlet tube 7 so that any vibration of the outfall chute 4 is not imparted to the measurement chute inlet tube 7.

The lower end of the measurement chute inlet tube 7 is coupled to the measurement chute assembly 20, which fundamentally includes a channel having a floor and side walls through which the objects to be sorted will travel. The measurement chute assembly 20 is positioned at an incline such that the object to be sorted will gravity feed from the upper end to the lower end of the measurement chute assembly 20. The inventor has determined that an incline of preferably between 15 and 25 degrees, and most preferably about 20 degrees provides sufficient incline to quickly and efficiently allow the spherical object to feed down the incline of the measurement chute assembly 20. The inventor has determined that greater inclines increase the likelihood of the objects bouncing down the incline of the measurement chute, thereby making it difficult for an accurate measurement of the object to be captured.

The measurement chute assembly 20 can be mounted to the support frame 1 or some other supporting mechanism. In the preferred embodiment, the measurement chute assembly 20 is mounted to a subframe assembly 26 which itself is mounted to a lower portion of the support frame 1. The support assembly 26 can be mounted to the support frame 1 by nuts and bolts, screws or other conventional fasteners. The measurement chute assembly 20 can be mounted to the support assembly 26 by nuts and bolts, screws or other conventional fasteners.

As provided in more detail below, the apparatus of the present invention utilizes a laser micrometer to measure the diameters of the objects to be sorted. At a minimum, the measurement chute assembly 20 of the present invention must have a channel through which the objects can travel along a path that is intersected by a laser beam transmitted by the laser micrometer.

Figure 5:
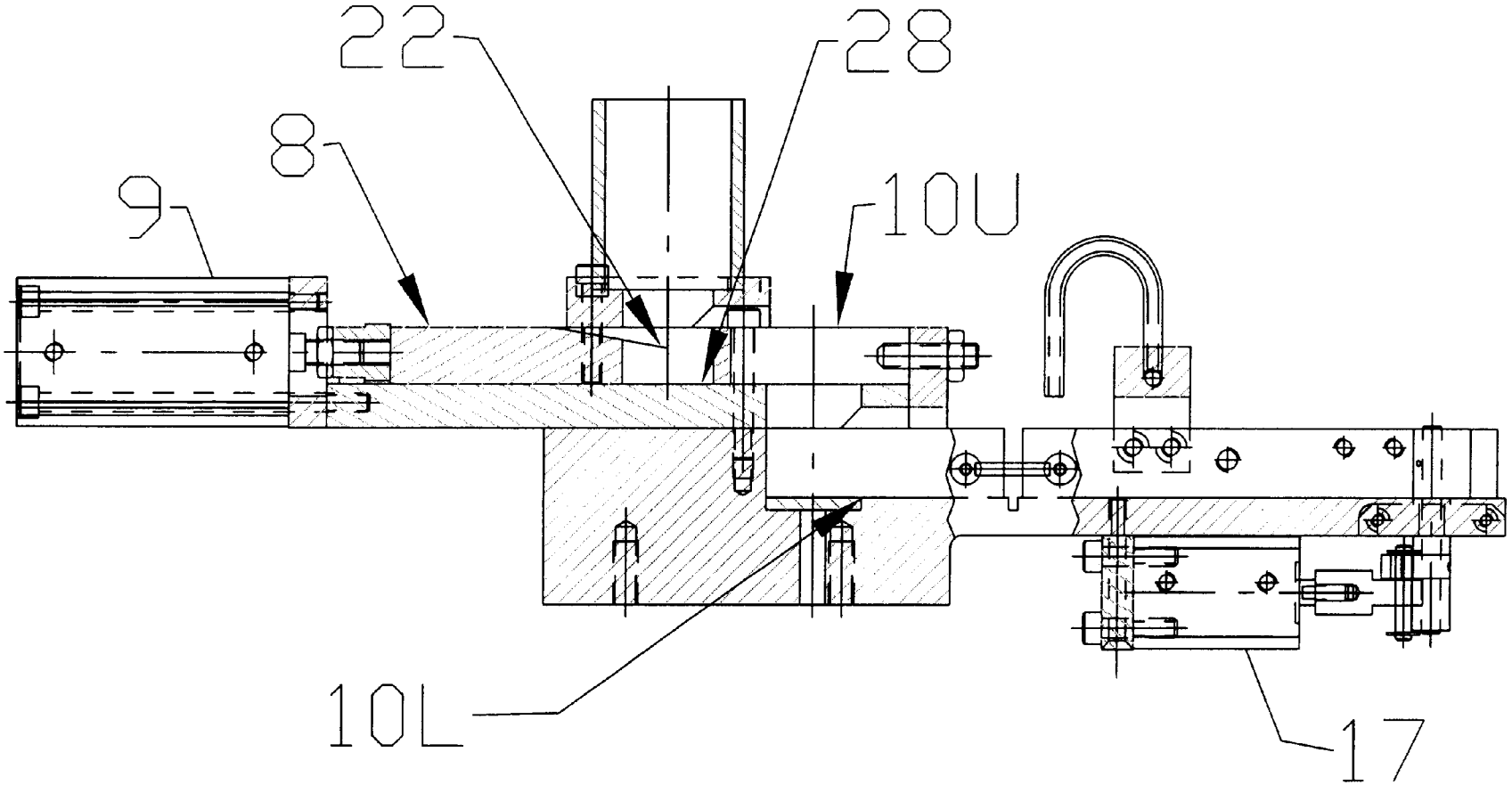
FIG. 5 is a side view of the measurement chute assembly.
Figure 6:
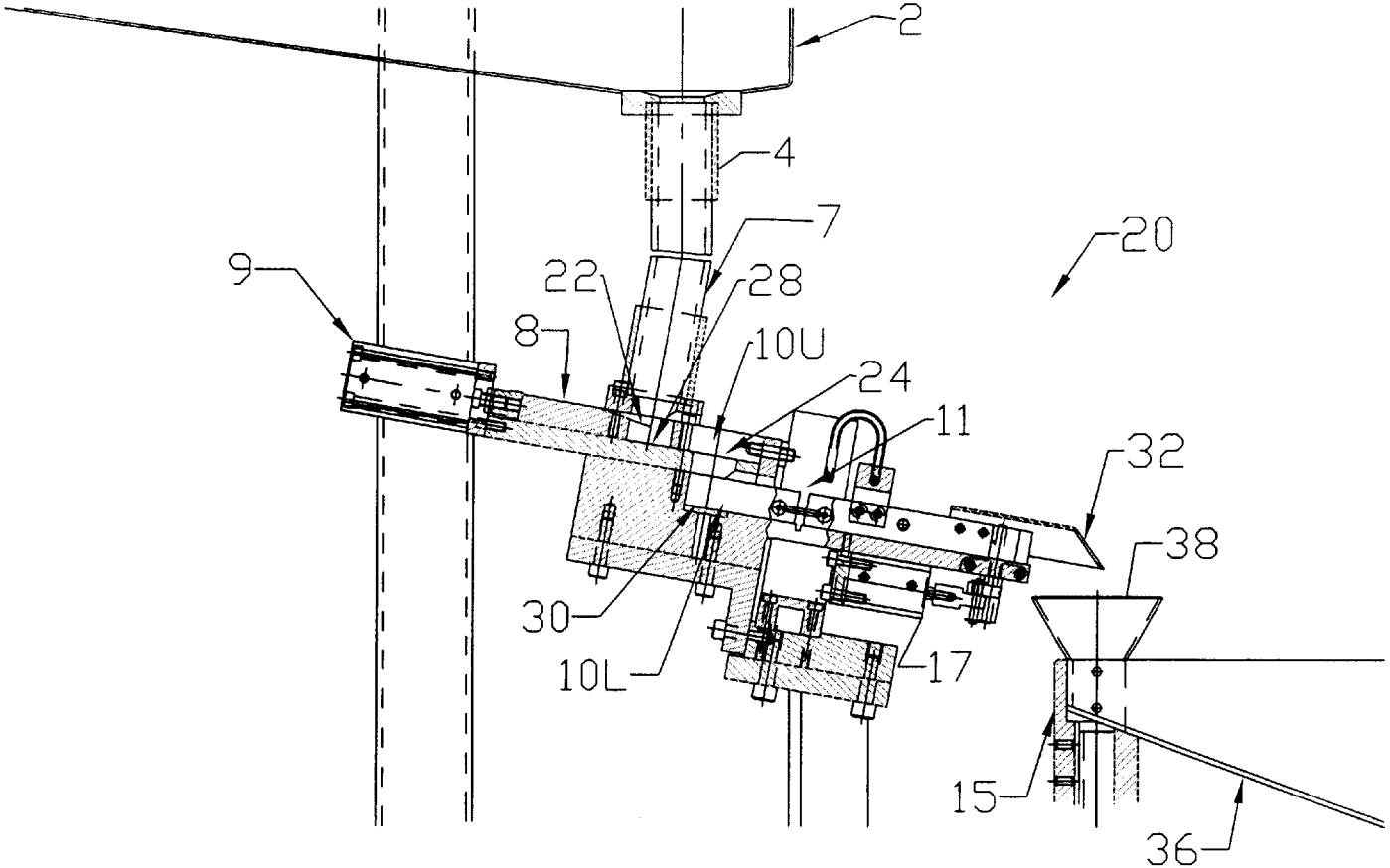
FIG. 6 is a side view of the measurement chute assembly.

As shown in FIGS. 5 and 6, the measurement chute assembly 20 of the preferred embodiment of the invention utilizes an upper channel 10U and a lower channel 10L to control the flow of the objects through the measurement chute assembly 20 and to ensure that one object at a time passes by the laser beam. The upper channel 10U and the lower channel 10L are both necessarily inclined at about the same angle as the measurement chute assembly 20, and each has an upper end and a lower end. The lower end of the measurement chute inlet tube 7 is mounted directly above the upper channel inlet 22 such that an object dropping through the measurement chute inlet tube 7 will drop directly into the upper channel 10U at its upper end.

A solid upper channel base plate 28 extends below the elevated portion of the upper channel 10U so as to provide a floor to that portion of the channel. The base plate 28 extends far enough along the upper channel 10U such that an object dropped through the measurement chute inlet tube 7 will fall onto the base plate 28 at the upper end of the upper channel 10U.

The preferred embodiment of the present invention includes a slide assembly 8 to ensure that only one object at a time is fed through the upper channel 10U and the lower channel 10L of the preferred embodiment. The slide assembly is positioned telescopically within the upper channel 10U. The slide assembly 8 is a solid rectangular block, preferably made of steel or some other suitable material, with an annular opening close to one end of the block. The annular opening must be of sufficient diameter such that the largest object to be sorted can pass through the opening.

As shown in FIG. 6, one end of the slide assembly 8 preferably is coupled to a pneumatically controlled cylinder 9 such that the pneumatically controlled cylinder 9 can linearly actuate the slide assembly 8 back and forth through the upper channel 10U. The bottom edge of the slide assembly 8 slides along an upper channel base plate 28 when retracting and extending. When in the retracted position, the annular opening of the slide assembly 8 is aligned directly below the measurement chute inlet tube 7 and the upper channel inlet 22. When in an extended position, the annular opening of the slide assembly 8 is aligned directly with the upper channel outlet 24.

The lower channel 10L is inclined at about the same angle as the upper channel 10U. A lower channel inlet 30 is located directly below the upper channel outlet 24 such that an object will gravity feed from the upper channel outlet 24 into the lower channel inlet 30. The floor portion of the lower channel is formed by a rigid base plate. At a point on the inclined floor of the lower channel 10L located below the lower channel inlet 30, the rigid base plate contains a small measurement slot 11 through which a laser beam can pass At the lower end of the lower channel 10L, there are means for alternatively preventing or allowing objects to gravity feed out of the lower channel 10L through the lower channel outlet 32. In the preferred embodiment shown in FIG. 4, two lower channel shutters 16 close or open to respectively prevent or allow an object to gravity feed through the lower channel outlet 32. In the embodiment shown, the lower channel shutters 16 are controlled by a second pneumatic cylinder 17 used to open and close the shutters 16. In the preferred embodiment shown, the shutters 16 are made of steel and are pivotally mounted to the measurement chute assembly 20 by steel hinge pins.

Figure 4:
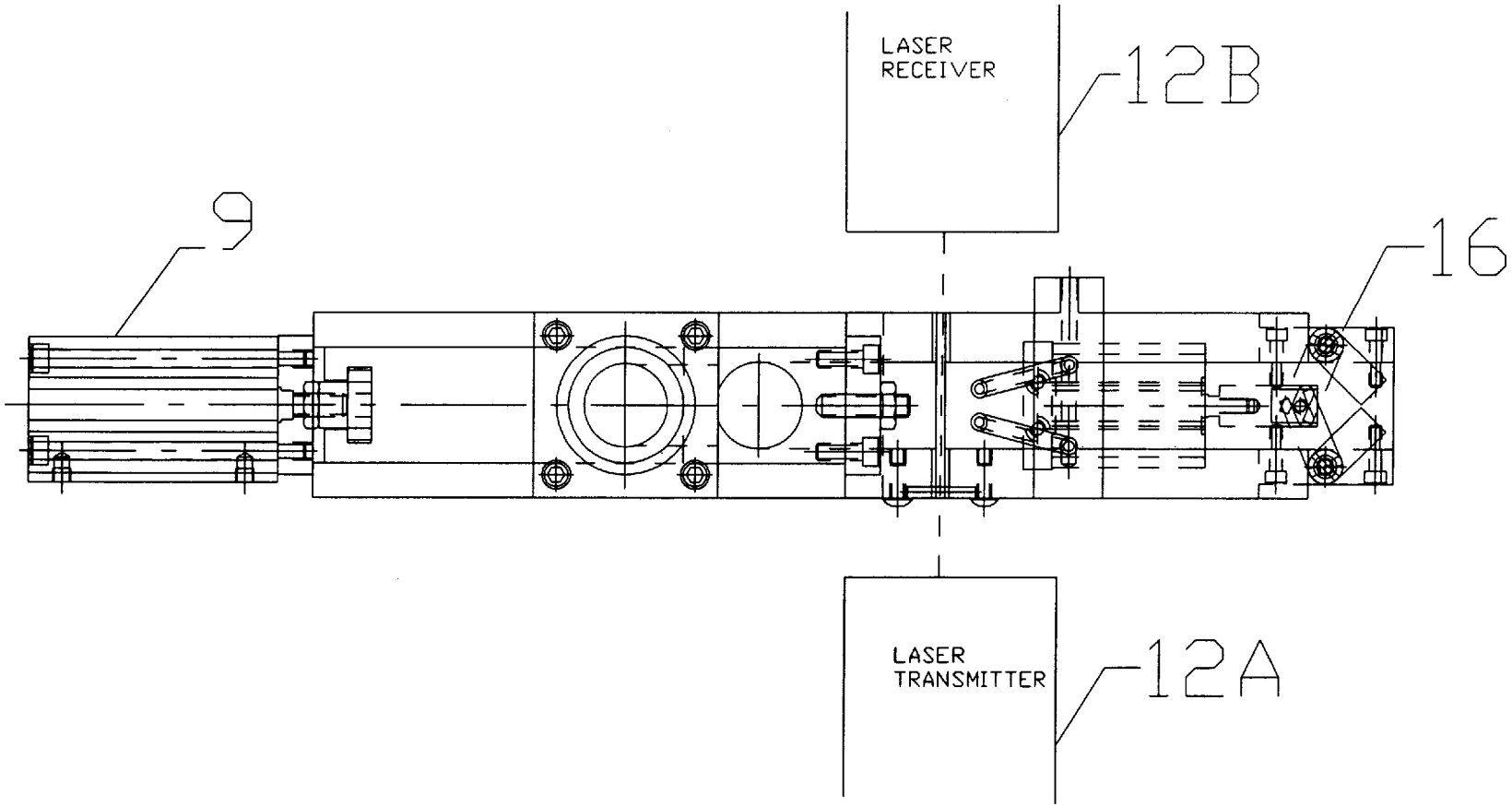
FIG. 4 is a top view of the measurement chute assembly.

As shown in FIG. 4, the apparatus of this invention includes a conventional laser micrometer that comprises a laser transmitter 12A and a laser receiver 12B. The laser transmitter 12A is mounted such that a laser beam can be transmitted through the measurement slot 11, through the lower channel 10L and received by the laser receiver 12B. The laser micrometer measures the largest diameter of each object to be sorted as the object feeds down the lower channel 10L. As the object feeds down the lower channel 10L, its path crosses perpendicularly to the laser beams thereby allowing the laser micrometer to capture its measurement. The applicant has found that the Keyence LS-5000 Series Laser Micrometer works sufficiently well in this apparatus and can measure the diameter of spherical objects to eight millionths of an inch. This is a laser scan micrometer with a scanning window that is 30×40 millimeters, with a measuring range of 0.2 to 40 millimeters. The light source is a red semiconductor laser (670 nm), 0.8 mW max. Class II laser. Maximum measuring accuracy is +/−2 um, with maximum repeatability of +/−0.3 um. Maximum laser scan rate is 1200 scans/second, with a laser scan velocity of 121 m/second.

The laser micrometer of the present invention is electronically coupled to computing means that receive signals from the laser micrometer indicating the respective diameters of the objects to be sorted. The computing means must also be able to send signals to a sorter mechanism, described below, in order to direct the apparatus to place each sorted object into a particular receptacle depending on the diameter of the object. The computing means of the preferred embodiment of the present invention is a Programmable Logic Controller ("PLC") (not shown), which can be located remotely from the sorting apparatus 50 for convenience of the operator. For the preferred embodiment of this invention, the inventor has successfully utilized a Mitsubishi 'MELSEC' PLC, with a MELSEC-A computer link module and AnS Module Type I/O. It is programmed with 'GPP-WIN' software. The use and programming of a computer, including a PLC, to operate and control a servomotor and other devices is routine in the industry. The programming of a PLC is readily apparent to one skilled in the art, and a further description of such programming is not provided herein.

The PLC of the preferred embodiment of this invention can be programmed to produce an audible signal to the operator at various milestones. For instance, the PLC can be programmed to produce an audible signal when a preset number of objects has been sorted or when a preset number of objects having a particular diameter have been sorted. This allows the sorting apparatus 50 of the present invention to run unattended.

Figure 7:
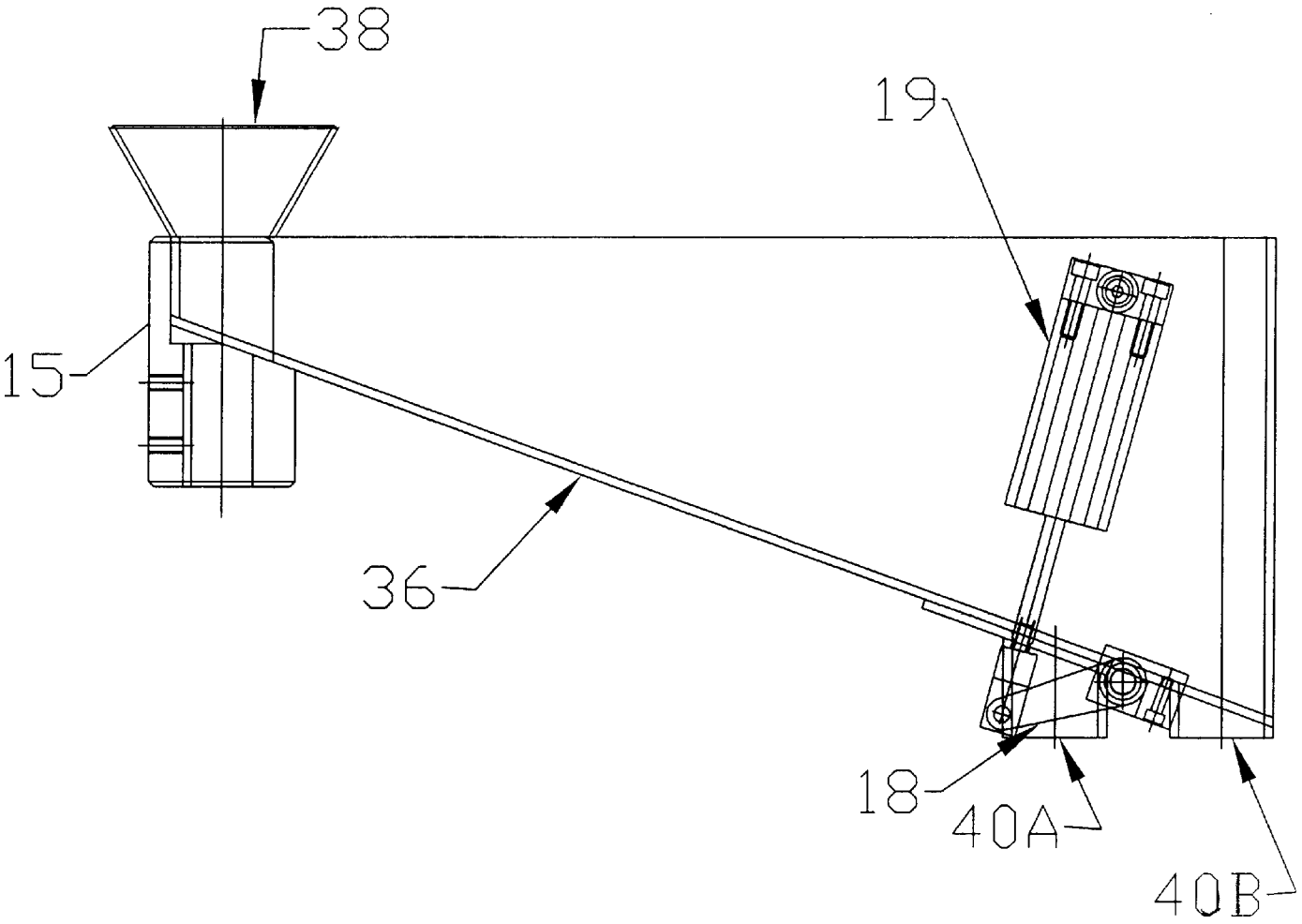
FIG. 7 is a side view of the sorting chute assembly.

As illustrated in FIG. 7, the sorter mechanism of the preferred embodiment of the invention includes a sorting chute 36. The sorting chute 36 has a sorting chute inlet 38 that is located directly below the lower channel outlet 32. The sorting chute 36 of the preferred embodiment has a unshaped interior with a floor inclined downwardly away from the sorting chute inlet 38. The sorting chute 36 is coupled rotatably to a shaft 15 that is fixably mounted to the subframe assembly 26, wherein said sorting chute 36 can rotate about the shaft 15. At the lower end of the inclined floor of the sorting chute 36 is two sorting chute outlets 40A and 40B, each of which is an annular opening in the floor of the sorting chute 36.

As shown in FIG. 7, the sorting chute 36 has attached a shutter 18 that is controlled by a third pneumatic cylinder 19.

The position of the shutter 18 determines whether an object to be sorted will fall through sorting chute outlet 40A or 40B.

Coupled to the shaft 15 via a pulley and belt assembly 14 is a servomotor 13. The servomotor 13 is electronically coupled to the PLC such that the PLC can send command signals to the servomotor 13 and the servomotor 13 can rotate the shaft 15 which in turn positions the sorting chute outlets 40A and 40B.

Figure 8:
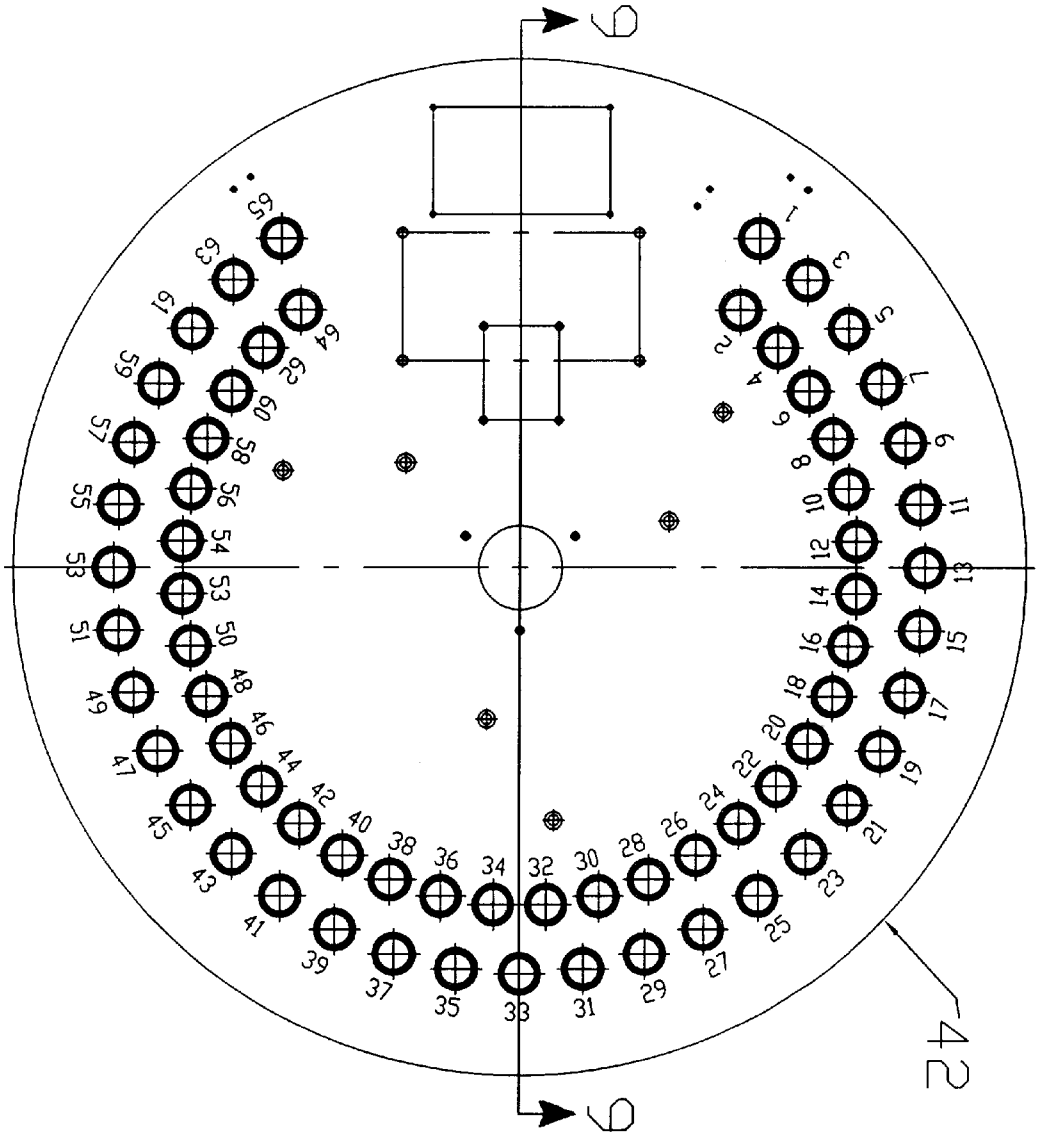
FIG. 8 is a top view of the sorting plate assembly.

The sorting mechanism of the preferred embodiment of the present invention utilizes a circular disc sorting plate 42 that is fixably mounted to the support assembly 26 such that it presents a circular disk on a horizontal plan below the sorting chute. As shown in FIG. 8, the sorting plate 42 has multiple annular holes positioned around the perimeter of the sorting plate 42. The preferred embodiment of the invention utilizes a sorting plate containing 65 sorting holes, all with a diameter larger than the largest object to be sorted, although virtually any number of holes can be utilized given space limitations.

Figure 9:
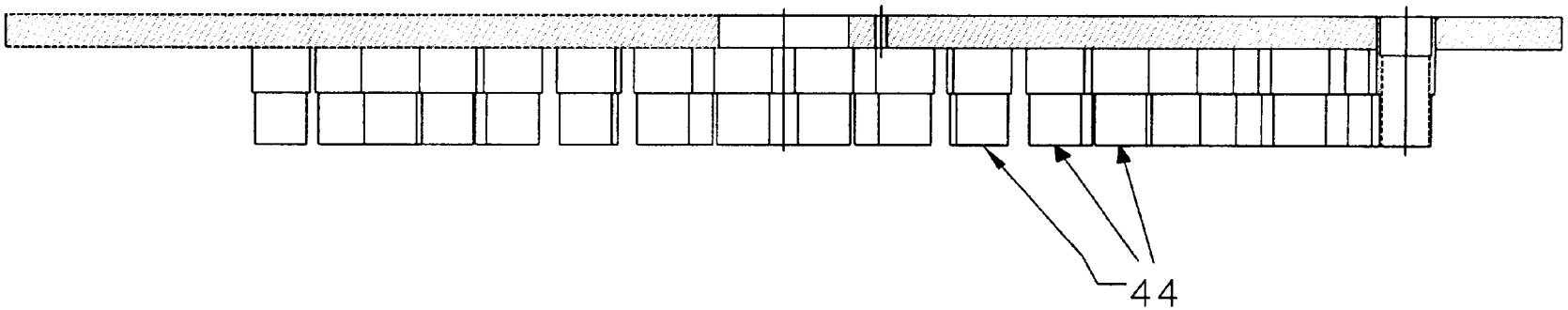
FIG. 9 is a sectional view of FIG. 8 along line A—A.

As shown in FIG. 9, mounted to the underside of the sorting plate 42 at the location of each of the holes are stub tubes 44. The stub tubes 44 are welded to the bottom of the sorting plate 42 at each of the sorting hole locations. Flexible tubing (not shown in the diagrams) can then be fastened to each stub tube 44 so that an object fed through a hole in the sorting plate 42 and through a particular stub tube 44 can be directed to a receptacle for that particularly sized object. The flexible tubing can be connected to the stub tubes 44 by stainless steel tubing clamps any other suitable fastening means.

Operation of the sorting apparatus 50 of this invention is now described through reference to a preferred embodiment which is illustrated in FIGS. 1–9. For purposes of this description, it will be assumed that the spherical objects to be sorted are ball bearings of varying dimensions. The ball bearings are manually loaded into the feed hopper 2. The agitator shaft 6 continuously rotates, thereby preventing the ball bearings from becoming jammed in the hopper outfall chute 4. Individual ball bearings gravity feed through the outfall chute 4 and through the measurement chute inlet tube 7 leading to the upper channel 10U of the measurement chute assembly.

One ball bearing is fed into the slide assembly 8 when the slide assembly 8 is in the retracted position. FIG. 6 shows the slide assembly 8 in the retraced position.

The PLC signals the pneumatically controlled cylinder 9 to extend, thereby linearly actuating the slide assembly 8 such that the annular opening of the slide assembly 8 becomes positioned at the upper channel outlet 24 and directly above the lower channel inlet 30. The ball bearing drops down into the lower channel 10L, and begins rolling down the incline of the lower channel 10L. The ball bearing's path down the incline is intersected at the measurement slot by the laser beam emitted by the laser transmitter 12A. The laser beam is received by the laser receiver 12B, which determines the largest diameter of the ball bearing. The laser receiver 12B produces a signal to the PLC indicating to the PLC the diameter of the ball bearing. The ball bearing continues down the incline of the lower channel 10L until it reaches the lower channel outlet 32. The ball bearing is restrained from further movement by the lower channel shutters 16 that are initially in a closed position.

After the ball bearing's measurement is determined by the laser micrometer, a signal is sent by the laser micrometer to the PLC. The PLC checks the measured diameter of the ball bearing against a pre-programmed list of diameter ranges. If the measured diameter falls within one of the preset ranges, the PLC directs the servomotor 13 to rotate the shaft 15 so that one of the sorting chute outlets, 40A or 40B, becomes positioned directly over the appropriate hole in the sorting plate 42.

For example, assume one of the pre-programmed diameter ranges in the PLC is a diameter range between 0.7510 and 0.7514 inches. The PLC would be programmed such that a ball bearing with a diameter in that range would be placed into one of the annular holes in the sorting plate 42 as shown in FIG. 8. For instance, the PLC may be programmed such that ball bearings falling within that diameter range fall into hole number 59 as shown in FIG. 8. The stub tube 44 connected to the sorting plate 42 at hole number 59 would be connected to flexible tubing that would lead to the appropriate receptacle to store ball bearings within the diameter range of 0.7510 and 0.7514 inches.

Once the sorting chute outlet 40B is positioned over the appropriate hole, the PLC sends a signal to the pneumatic cylinder 17 that controls the lower channel shutters 16 to release the ball bearing through the lower channel outlet 32 into the sorting chute inlet 38. The ball gravity feeds down the incline of the sorting chute 36 toward the sorting chute outlets 40A and 40B. In the embodiment shown in FIG. 7, the sorting chute 36 contains a sorting chute shutter 18 which is controlled by a third pneumatic cylinder 19. In the preferred embodiment of the present invention, the sorting plate 42 has two concentric rows of holes to efficiently use available space on the sorting plate 42. Depending on which row the appropriate hole is for the measured ball bearing, the PLC will signal the pneumatic cylinder 19 to appropriately position the sorting chute shutter 18 so that the ball bearing drops through the appropriate sorting chute outlet, 40A or 40B, to the appropriate hole in the sorting plate 42. In this example, because the desired hole 59 is located on the outer ring of holes, the sorting chute shutter 18 would close, thereby directing the ball bearing to sorting chute outlet 40B.

The PLC continues to tabulate each ball bearing sorted. The PLC also continuously tabulates the number of ball bearings sorted into each preset diameter range. The PLC can be programmed to signal an alarm to the operator when i certain amount of ball bearings have been sorted. This may aid the operator in knowing when the feed hopper 2 needs to be manually or otherwise filled. The PLC can also be programmed to signal an alarm to the operator when a certain number of ball bearings have been sorted into one of the preset diameter ranges. This may be useful for a variety of reasons, including alerting the operator when a particular collection receptacle is becoming full.

If the measured ball bearing does not fall within one of the preset measurement ranges, the PLC will direct the servomotor 13 to position the sorting chute outlet 40 over a hole in the sorting plate 42 designated for "rejected" ball bearings. The ability to reject ball bearings that do not fall within particular preset diameter ranges allows the operator to reject ball bearings that may have physical defects thereby making them a size other than their normal diameter. This ability also helps the operator efficiently "weed out" ball bearings that have a size that is not useful to the operator.

Once the ball bearing is dropped through an appropriate hole in the sorting plate 42, the PLC directs the pneumatic cylinder 9 to retract the slide assembly 8 such that another ball bearing can begin its cycle through the sorting process. The PLC controls the timing of the apparatus of the preferred embodiment so that the servomotor 13 positions the appropriate sorting chute outlet above the corresponding hole on the sorting plate 42 before the slide assembly 8 will retract. This way, gravity and centrifugal force allows a ball bearing to be sorted and deposited before the next ball bearing passes by the measurement slot 11, which in turn triggers the PLC to direct the servomotor 13 to reposition the sorting chute. The inventor has utilized the preferred embodiment of the invention to sort 2400 ball bearings per hour, with tolerances within 0.0002 inches.

Although a preferred embodiment of the invention has been described using specific terms, such description is for illustrative purposes only, and it is to be understood that changes and variations may be made without departing from the scope or spirit of the following claims.

What is claimed is:

1. A sorting apparatus comprising:

a. a support frame;

b. a measurement chute having an inlet end and an outlet end, a channel with a floor and two side walls, said channel between the inlet end and the outlet end, wherein said floor includes a measurement slot transecting completely through the floor, wherein said measurement chute is mounted to the support frame at an incline such that the inlet end is higher than the outlet end;

c. a feeder, having a container in which the objects are temporarily stored, wherein the feeder is coupled to the support frame and feeds the objects into the measurement chute at the inlet end of the measurement chute;

d. a laser micrometer having a laser beam transmitter and a laser beam receiver, wherein the laser beam transmitter and the laser beam receiver are coupled to the support frame on opposite sides of the measurement slot, such that, in operation, a laser beam is directed by the laser beam transmitter through the measurement slot and received by the laser beam receiver;

e. a computer electronically coupled to the laser micrometer; and f. a sorter mechanism coupled to the support frame and electronically coupled to the computer, said sorter mechanism having a sorting chute rotatably mounted on a rotating shaft with a sorting chute inlet located directly below the measurement chute outlet, and a sorting chute outlet located above a plurality of radially spaced-apart receptacles disposed about said rotating shaft, wherein said sorter mechanism receives the objects to be sorted in the sorting chute inlet and releases the objects through the sorting chute outlet into one of the plurality of receptacles based upon the signal received from the computer.

2. The apparatus as claimed in claim 1, wherein said feeder is a hopper having a base and a peripheral raised wall with an opening in said base, wherein the objects gravity feed through the opening.

3. The apparatus as claimed in claim 1, further comprising an agitator for agitating the objects in the feeder.

4. The apparatus as claimed in claim 1, wherein the computer is a programmable logic controller.

5. The apparatus as claimed in claim 1, wherein said computer includes means for producing an audible signal when a preset number of said objects has been sorted.

6. The apparatus as claimed in claim 1, wherein said computer includes means for producing an audible signal when a preset number of said objects having a particular diameter has been sorted.

7. The apparatus as claimed in claim 1, wherein said objects are spherical objects.

8. A sorting apparatus comprising:

a. a support frame;

b. a measurement chute mounted at an incline to the support frame, wherein said measurement chute comprises:

an upper channel having a floor and two side walls, said upper channel having an inlet end and an outlet end, with the inlet end situated higher than the outlet end, and a lower channel having a floor and two side walls, said lower channel having an inlet end and an outlet end with the inlet end situated higher than the outlet end, wherein the lower channel inlet end is located directly below the outlet end of the upper channel, and wherein the floor of the lower channel has a measurement slot transecting completely through the floor of the lower channel;

c. a feeder, having a container in which the objects are temporarily stored, wherein the feeder is coupled to the support frame and feeds the objects into the inlet end of the upper channel of the measurement chute;

d. a laser micrometer having a laser beam transmitter and a laser beam receiver, wherein the laser beam transmitter and the laser beam receiver are coupled to the support frame on opposite sides of the measurement slot, such that, in operation, a laser beam is directed by the laser beam transmitter through the measurement slot and received by the laser beam receiver;

e. a computer electronically coupled to the laser micrometer;

f. a sorting mechanism coupled to the support frame, having a vertical shaft rotatably fixed to the support frame, a sorting chute wherein said sorting chute has an inlet end and an outlet end, wherein said sorting chute comprises a floor and two side walls, wherein said sorting chute floor is inclined downwardly away from the inlet end of the sorting chute, and wherein said floor of the sorting chute contains at least one hole at the outlet end of the sorting chute, wherein said inlet end of the sorting chute is located directly below the outlet end of the lower channel, wherein said sorting chute is coupled to the vertical shaft at the inlet end of the sorting chute such that the sorting chute can rotate about the vertical shaft;

g. a sorting plate having a top and bottom surface and a plurality of holes extending through the top and bottom surfaces, wherein said sorting plate is mounted to the supporting frame such that said top and bottom surfaces are on a horizontal plane;

h. a plurality of sorting tubes having inlet ends and outlet ends, wherein said inlet ends of the sorting tubes are fastened to the bottom surface of the sorting plate adjacent to the plurality of holes in the sorting plate;

i. a plurality of receptacles situated directly below the outlet ends of the sorting tubes; and j. a servomotor coupled to the vertical shaft via a pulley and belt system for rotating the shaft and positioning the at least one hole of the sorting chute over one of the plurality of holes in the sorting plate.

9. The apparatus as claimed in claim 8, wherein said feeder is a hopper, said hopper having a base and four walls with an opening in said base, wherein the objects gravity feed through the opening.

10. The apparatus as claimed in claim 8, wherein said measurement chute further comprises a slide assembly telescopically situated within the upper channel, wherein the slide assembly directs the objects from the inlet end of the upper channel of the measurement chute to the outlet end of the upper channel of the measurement chute.

11. The apparatus as claimed in claim 8, further comprising an agitator for agitating the objects in the feeder.

12. The apparatus as claimed in claim 8, wherein the computer is a programmable logic controller.

13. The apparatus as claimed in claim 8, wherein said computer includes means for producing an audible signal when a preset number of said objects has been sorted.

14. The apparatus as claimed in claim 8, wherein said computer includes means for producing an audible signal when a preset number of said objects having a particular diameter has been sorted.

15. The apparatus as claimed in claim 8, wherein said objects are spherical objects.

16. A method of sorting spherical objects according to their diameters, comprising:

a. feeding the objects to an elevated end of an inclined measurement chute having a measurement slot and rolling the objects down the measurement chute under the influence of gravity;

b. measuring the diameter of the objects as said objects roll down the inclined measurement chute over the measurement slot by way of a laser micrometer transmitting a laser beam through the measurement slot;

c. transmitting a signal from the laser micrometer to a computer, said signal identifying the diameter of the objects; and d. directing a sorter mechanism to place the objects into one of a plurality of receptacles based on the diameter of the objects.

* * * * *